US007431495B2

(12) United States Patent
Cretin et al.

(10) Patent No.: US 7,431,495 B2
(45) Date of Patent: Oct. 7, 2008

(54) DAMPING DEVICE, PARTICULARLY FOR A WRIST-WATCH

(75) Inventors: Christophe Cretin, Bellefontaine (FR); Laurent Morel, Bellefontaine (FR)

(73) Assignee: Richemont International S.A., Villars-Sur Glane (CH)

( * ) Notice: Subject to any disclaimer, the term of this patent is extended or adjusted under 35 U.S.C. 154(b) by 0 days.

(21) Appl. No.: 11/884,576

(22) PCT Filed: Feb. 8, 2006

(86) PCT No.: PCT/IB2006/000341

§ 371 (c)(1),
(2), (4) Date: Aug. 17, 2007

(87) PCT Pub. No.: WO2006/087631

PCT Pub. Date: Aug. 24, 2006

(65) Prior Publication Data

US 2008/0101165 A1 May 1, 2008

(30) Foreign Application Priority Data

Feb. 18, 2005 (CH) ..... 00283/05

(51) Int. Cl.
*G04B 37/00* (2006.01)

(52) U.S. Cl. ..... 368/287; 368/291; 368/309

(58) Field of Classification Search ..... 368/88, 368/281, 286, 287, 291, 292, 297, 299, 309
See application file for complete search history.

(56) References Cited

U.S. PATENT DOCUMENTS

| | | | | |
|---|---|---|---|---|
| 1,828,687 | A | 10/1931 | Schwarz | |
| 3,491,532 | A * | 1/1970 | Glass | 368/287 |
| 3,727,367 | A * | 4/1973 | Fujimori et al. | 368/287 |
| 3,735,584 | A * | 5/1973 | Tokunaga | 368/287 |
| 3,855,786 | A * | 12/1974 | Yamamoto | 368/287 |
| 6,575,619 | B1 * | 6/2003 | Stauffer | 368/299 |
| 6,762,976 | B1 * | 7/2004 | Tamaru et al. | 368/88 |

FOREIGN PATENT DOCUMENTS

| | | |
|---|---|---|
| CH | 247 483 | 3/1947 |
| CH | 443 158 | 3/1967 |
| CH | 513 453 | 4/1971 |
| EP | 1 041 461 | 10/2000 |
| EP | 1 076 273 | 2/2001 |

* cited by examiner

*Primary Examiner*—Vit W Miska
(74) *Attorney, Agent, or Firm*—Young & Thompson

(57) ABSTRACT

A damping device, more particularly for a watchcase, includes a case (1) the back (7) of which has an extension provided with a groove (13) holding a gasket (14). The device further includes a support (2, 3) the lower segment (2) of which has a compression chamber (18) cooperating with the extension of the back of case (1), this extension being able to move axially, and in air-tight fashion, in this chamber (18). This lower segment (2) of the support is linked to a ring (3) against which case (1) leans in its rest position.

12 Claims, 3 Drawing Sheets

DAMPING DEVICE, PARTICULARLY FOR A WRIST-WATCH

Object of the present invention is a damping device intended more particularly for a wristwatch.

When wearing a wristwatch it often happens that the user inadvertently knocks against a piece of furniture or a wall with the crystal or watch glass. The resulting shock may give rise to damage, not only to the watch glass but also—when the shock is violent—to the watch mechanism.

It is the aim of the present invention to realize a shock-protection or damping device able to damp the shocks, and more particularly axial shocks, that the watch may suffer, in order to avoid all damage to the watch movement.

The damping device intended more particularly for a wristwatch, according to the present invention is distinguished by the characteristics listed in claim 1 ff.

The annexed drawing illustrates schematically and by way of example an embodiment of the shock-protection device applied to a wristwatch.

Figure 1:
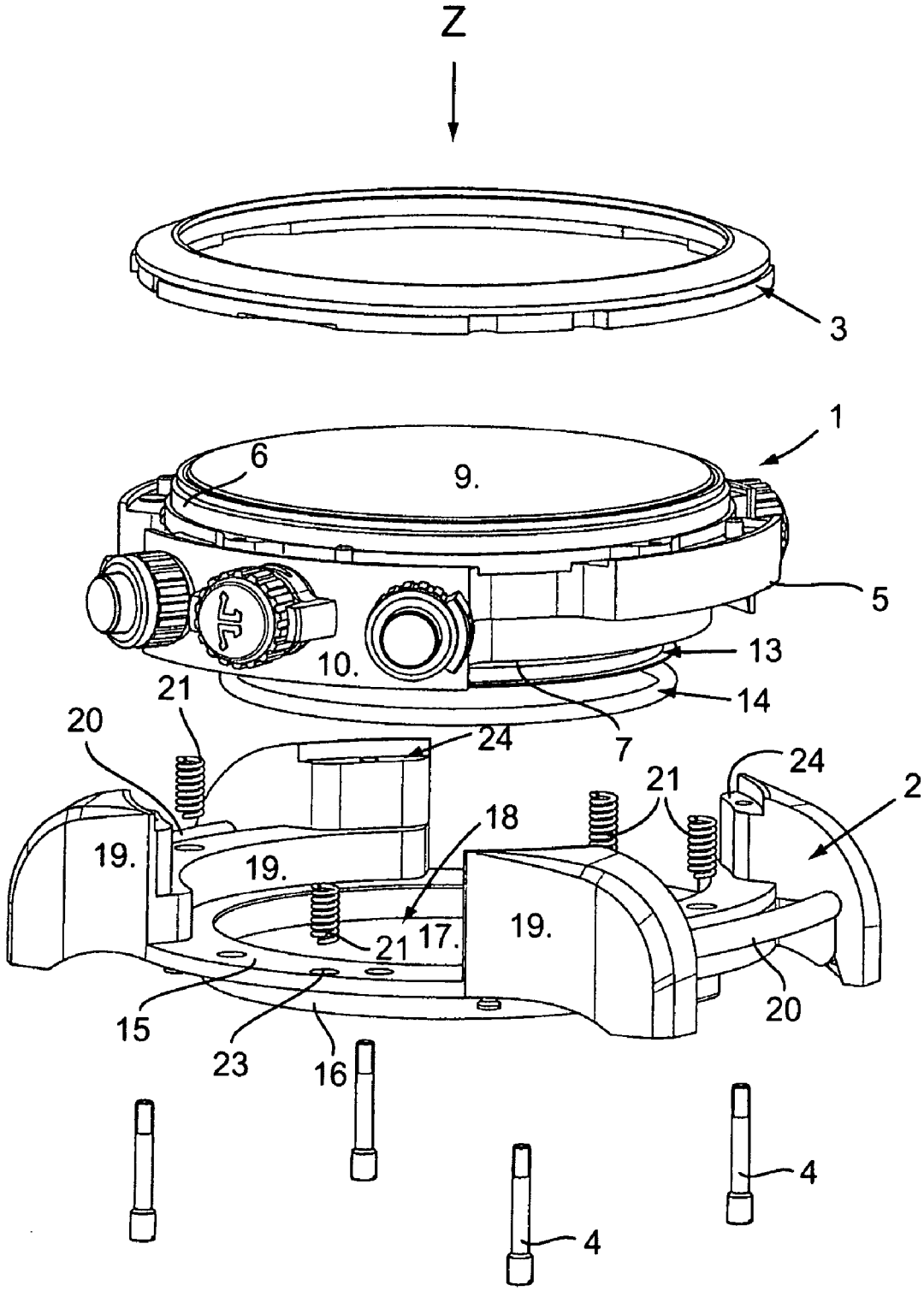
FIG. 1 is an exploded view of the shock-protection device.
Figure 2:
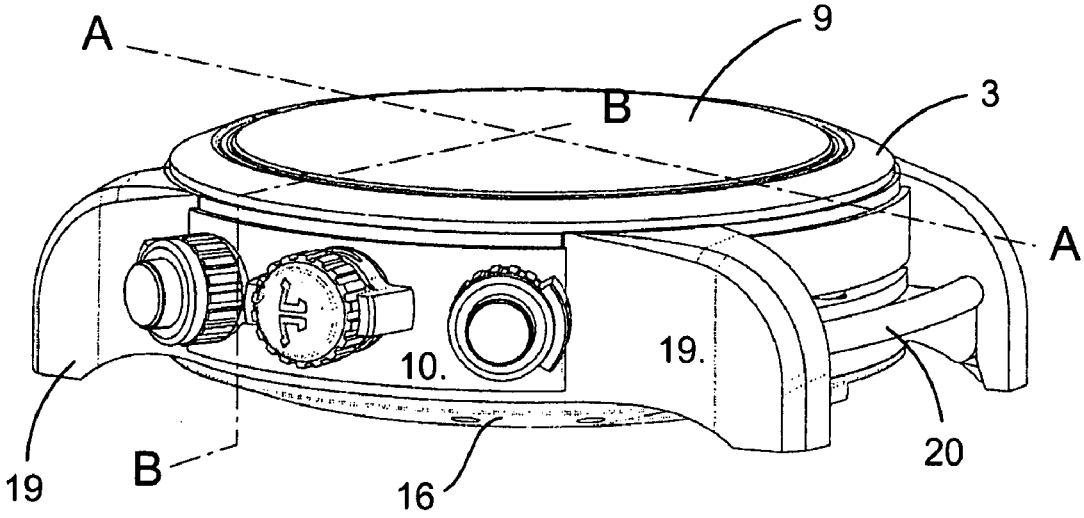
FIG. 2 is a general view of the shock-protection device.
Figure 3:
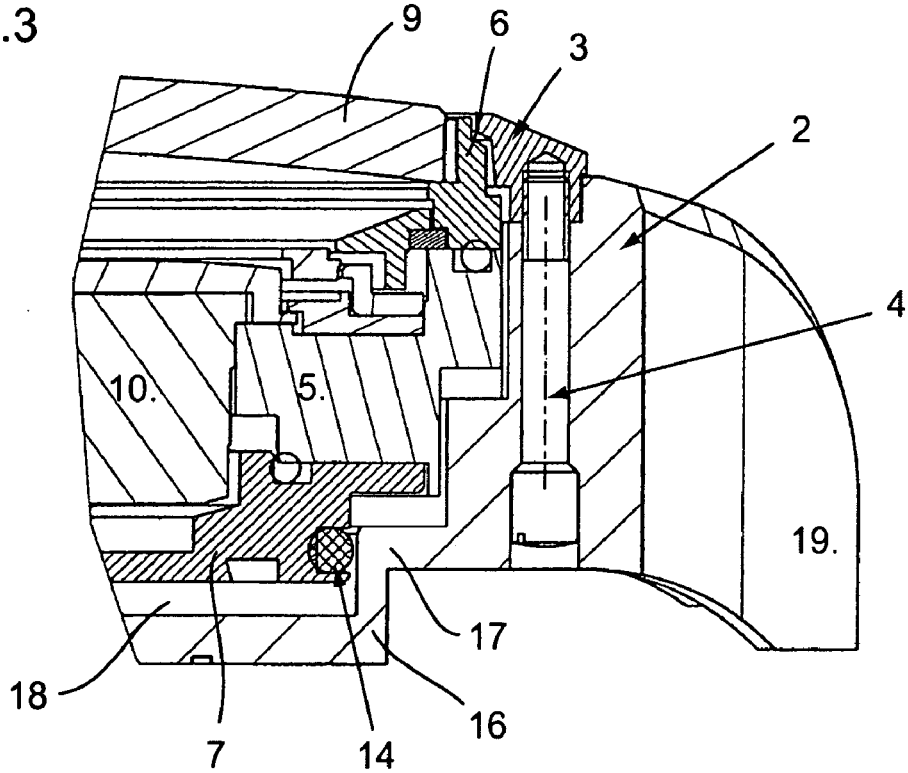
FIG. 3 is a partial section of the shock-protection device along line A-A in FIG. 2.
Figure 4:
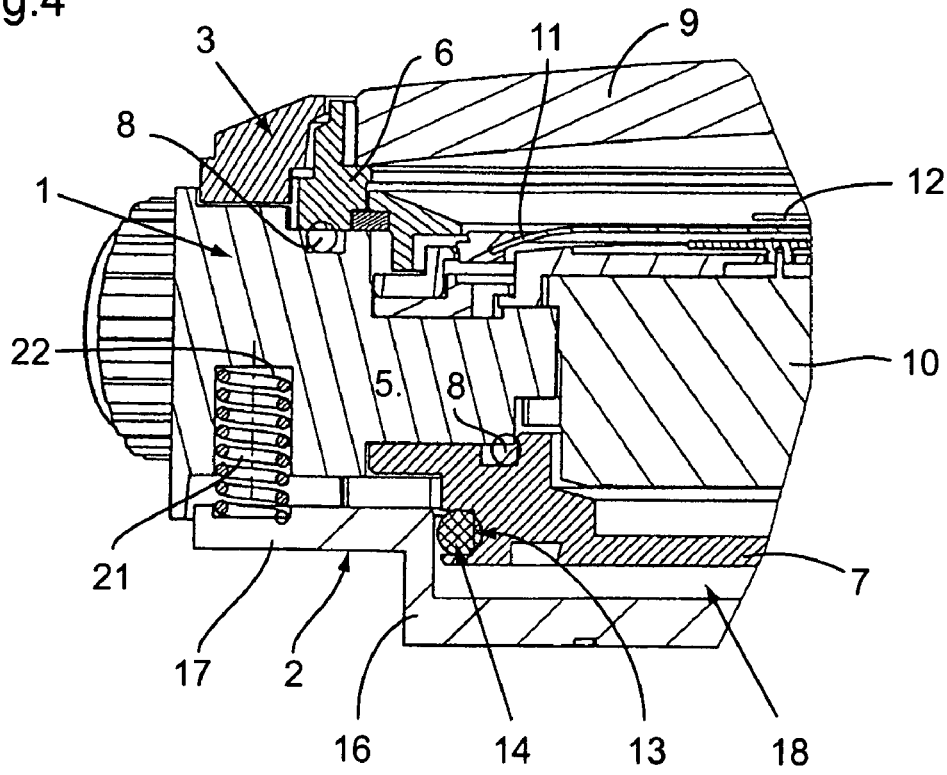
FIG. 4 is a partial section of the shock-protection device along line B-B in FIG. 2, the device being in its condition of rest.
Figure 5:
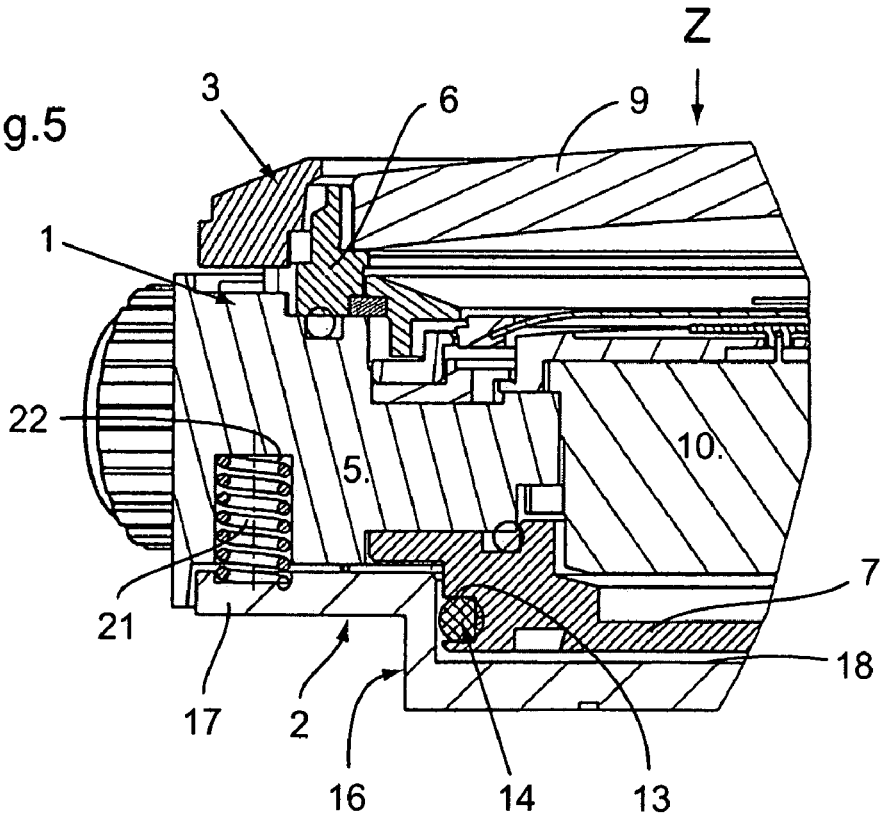
FIG. 5 is a partial section of the shock-protection device along line B-B in FIG. 2, the device being in its active position under the impact of an axial shock.

The shock-protection or damping device according to the invention that is illustrated in the drawings as an example applied to a wristwatch, consists of an inner case 1 mounted, as seen in what follows, into an outer support consisting of a lower segment 2 and an upper ring 3 linked by fastening screws 4.

The inner case 1 here consists of a middle 5, a bezel 6, and a back 7 of the case. The back 7 of the case and the bezel 6 are screwed onto the middle 5 while gaskets 8 secure water-tightness of this inner case 1. A glass 9 is set onto the bezel in water-tight fashion. Thus constituted, the case 1 holds enclosed a watch movement 10, a dial 11, and the hands 12 of the watch.

As mounted, this inner case 1 represents a water-tight monolithic group enclosing the watch movement.

It is obvious that in variants, this inner case 1 could hold a mechanism other than a watch movement and even any other object or device that must be protected against shocks.

Back 7 of this inner case 1 comprises a cylindrical portion having a smaller diameter, and forming a piston. A groove 13 made in the peripheral surface of this piston serves as seat of a gasket 14.

The lower segment 2 of the outer support includes an annular flange 15. The inner circumference of this flange 15 is extended on the lower side of flange 15 as a cylindrical wall 16 closed off by a bottom 17. This cylindrical wall 16 and this bottom 17 make up a compression chamber 18. The inner diameter of this compression chamber 18 is arranged in such a way that the piston of back 7 of the inner case is able to axially slide without play, and in air-tight fashion, in this compression chamber 18.

On its other side, that is, the upper side, flange 15 is provided with guiding elements 19 for certain outer faces of inner case 1. When the inner case 1 has thus been set up on its support, its piston that is formed by the lower segment of its back 7 slides in air-tight fashion in the compression chamber 18.

In the example illustrated, these guiding elements 19 at once constitute the horns that are able to take up the bars 20 for fixing a bracelet.

Springs 21 are arranged in blind bores 22 made in the middle 5 and opening on its lower face. When inner case 1 has been placed into the support, the ends of springs 21 sticking out from bores 22 in this middle are received in corresponding recesses 23 made in the upper face of flange 15.

The guiding elements 19 of the lower segment 2 of the outer support also have upper supporting surfaces 24 taking up and positioning the upper ring 3 that is fixed to the lower segment 2 of the outer support with the aid of screws 4.

In its assembled state, therefore, the shock-protection or damping device comprises the inner case 1 able to axially slide in the outer support 2, 3 against the action of springs 21 and of the compressed air contained in the compression chamber 18 that holds the piston of back 7 of the inner case.

In its rest position, inner case 1 is held against the upper ring 3. When glass 9, and thus the inner case 1, is subject to an axial shock, the inner case 1 is displaced while compressing spring 21, as well as the air held in the compression chamber, which results in progressive braking of the inner case 1, and thus to an efficient damping of the shock suffered by this inner case 1.

The return to the rest position after the shock occurs under the combined action of springs 21 and of expansion of the compressed air held in compression chamber 18.

The principle of the shock-protection or damping device or of the shock absorbers according to the invention thus consists of mounting an inner case 1 into a support 2, 3 so that it may slide along an axis, the inner case being subject to an elastic effect tending to hold it in its rest position.

Moreover, inner case 1 has a cylindrical extension made as a piston cooperating with a compression chamber that is part of the lower segment 2 of support 2, 3. This piston moves axially, and in air-tight fashion, in the compression chamber and thus gives rise to compression of the air held in this chamber 18 when moving, thus acting as a shock absorber.

The assembly of the damping device is very simple, the inner case 1 is fitted with its gasket 14, and the springs 21 are placed into the blind bores 22 provided for them in middle 5. This subgroup then is mounted into the lower segment 2 of the support, then ring 3 is screwed onto the lower segment 2 of the support.

The invention claimed is:

1. Damping device, more particularly for a watchcase, characterised in that it comprises a case (1) the back (7) of which comprises an extension provided with a groove (13) holding a gasket (14); in that it also comprises a support (2, 3) a lower segment (2) of which comprises a compression chamber (18) cooperating with the extension of the back of case (1), this extension being able to move axially, and in a air-tight fashion, in this chamber (18); and in that this lower segment (2) of the support is linked to a ring (3) against which case (1) leans in its rest position.

2. Device according to claim 1, characterized in that case (1) is a watchcase.

3. Device according to claim 2, characterized in that the lower segment (2) of support (2, 3) comprises fastening elements (20) for a bracelet.

4. Device according to claim 1, characterized in that an elastic effect tends to move case (1) away from the lower segment (2) of support (2, 3).

5. Device according to claim 4, characterised in that this elastic effect is realised by one or several helical springs (21) set into blind bores (22) in middle (5) of case (1) and resting on a flange (15) of the lower segment (2) of the support (2, 3).

6. Device according to claim 1, characterised in that a ring (3) of the support is fastened to the lower segment (2) of support (2, 3) with the aid of screws (4).

7. Device according to claim 2, characterised in that an elastic effect tends to move case (1) away from the lower segment (2) of support (2, 3).

8. Device according to claim 3, characterised in that an elastic effect tends to move case (1) away from the lower segment (2) of support (2, 3).

9. Device according to claim 2 characterised in that a ring (3) of the support is fastened to the lower segment (2) of support (2, 3) with the aid of screws (4).

10. Device according to claim 3 characterised in that a ring (3) of the support is fastened to the lower segment (2) of support (2, 3) with the aid of screws (4).

11. Device according to claim 4 characterised in that a ring (3) of the support is fastened to the lower segment (2) of support (2, 3) with the aid of screws (4).

12. Device according to claim 5 characterised in that a ring (3) of the support is fastened to the lower segment (2) of support (2, 3) with the aid of screws (4).

* * * * *